United States Patent [19]

Peck

[11] Patent Number: 4,889,031

[45] Date of Patent: Dec. 26, 1989

[54] FIREARM LOADING MECHANISM FOR AN AUTOMATED CANNON

[75] Inventor: John H. Peck, Fountain Valley, Calif.

[73] Assignee: McDonnell Douglas Helicopter Company, Mesa, Ariz.

[21] Appl. No.: 131,562

[22] Filed: Dec. 11, 1987

[51] Int. Cl.[4] ..... F41D 10/08

[52] U.S. Cl. ..... 89/33.2

[58] Field of Search ..... 89/33.04, 33.14, 33.2

[56] References Cited

U.S. PATENT DOCUMENTS 2,899,865 8/1959 Colby ..... 89/33.2

3,221,603 12/1965 Lochhead ..... 89/33.2

FOREIGN PATENT DOCUMENTS 717373 2/1942 Fed. Rep. of Germany ..... 89/33.2

*Primary Examiner*—Stephen C. Bentley

*Attorney, Agent, or Firm*—Beehler, Pavitt, Siegemund, Jagger, Martella & Dawes

[57] ABSTRACT

A linkage is provided between various components within the feed mechanism of an automated gun which allows a feed cover, which includes some of the components of the feed mechanism, to be opened relative to other elements within the feed mechanism in order to allow access or changing of ammunition within the feed mechanism without unlinking the various feed mechanism components. Feed mechanism components within the gun are linked to other feed mechanism components within the rotatable feed cover by means of a ball and bracket combination. The feed cover rotates about a pivot pin on a predetermined axis. The bracket, through which the motive power supplied to the components of the feed mechanism and the feed cover is disposed to lie on and is rotatable about the predetermined axis defined by the pivot pin. The ball, which is disposed on a rotatable lever coupled to feed mechanism components within the remaining portion of the gun, extends into the bracket so that the bracket may rotate about the ball when the feed cover is rotated on the predetermined axis defined by the pivot pin, and yet the bracket and ball remain operatively connected while the lever upon which the ball is disposed rotates about the differently oriented axis of rotation. The ball and bracket coupling is thus never disengaged even when the feed cover and the bracket with it is rotated relative to the ball.

21 Claims, 5 Drawing Sheets

FIREARM LOADING MECHANISM FOR AN AUTOMATED CANNON

BACKGROUND OF THE INVENTION

1. Field of the Invention

The invention relates to the field of gun mechanisms and in particular to an improvement in the ammunition feed mechanism of an automated cannon to allow access to the ammunition belts in the feed mechanism without loss of synchronization or need to resynchronize the feed mechanism.

2. Description of the Prior Art

The prior art has developed many designs for allowing an ammunition feed mechanism for handling belted ammunition to be accessed and changed. Very often the feed cover of the mechanism is incorporated in some manner with the operation of the feed mechanism itself. Opening the cover, therefore, unlinks the feed mechanism components from each other so that when a new belt of ammunition is placed within the feed mechanism, various ones of the components become misadjusted with respect to other ones. Therefore, when the feed cover is to be closed, the components must be realigned in order to avoid a jam.

Typical of such prior art mechanisms is LOCHHEAD, "Cartridge Feeding Mechanism for Fixed Barrel, Slide-Operated Guns", U.S. Pat. No. 3,221,603 (1965). In LOCHHEAD the ammunition cartridges 56 are placed in a transverse feedway 58 to the rear of barrel 14 and immediately above the path of travel of a bolt 18. Access to the ammunition feedway 58 is provided to cover 60, which is pivoted at its forward end and latched at its rear end by latch 62. The underside of cover 60 is transversely slotted to form a track 64 for slidingly receiving a feed slide 66. Therefore, when cover 60 is lifted, its cooperation of linking with underlying elements is disrupted and leaving open the possibility that feed slide 66 may become misaligned with track 64 defined on the bottom of cover 60.

Another prior art reference with a similar defect is shown in COLBY, "Cartridge Feeding Mechanism", U.S. Pat. No. 2,899,865(1959). Cartridges 18 on belt 22 are fed into the gun by means of a feeder 28 mounted on a receiver 14 as best seen in COLBY's FIG. 1. Feeder 24 includes a tray 26 for slidingly supporting belt 22 through an entrance port 21 across the feeder and to an injection port 23. The entire feed mechanism is hinged thorugh a pin shown in the upper right hand corner of COLBY's FIGS. 1 and 4. Pin follower 54 is moved out of alignment with a cylindrical member 50 during pivoting of the entire feed mechanism upwardly. Cylindrical tip 56 is thus withdrawn from groove 58 provided in crosshead 60. Therefore, the possibility arises that various pins and followers may be misaligned when the ammunition feed mechanism is opened.

Therefore, what is needed is an improvement in a feed mechanism for such automatic weapons wherein the feed mechanism may be opened, the ammunition belt changed,and closed without loss of linking or synchronization of the various components of the feed mechanism.

BRIEF SUMMARY OF THE INVENTION

The invention is an improvement in a feed mechanism for feeding ammunition to an automated gun comprising a feed mechanism for for automatically feeding ammunition to the gun for firing. An openable feed cover mechanism automatically provides ammunition to the gun in cooperation with the feed mechanism. The feed cover mechanism is openable to allow access to ammunition supplied to the gun for firing. The feed cover mechanism is disposed in a portion of the gun separable at least in part from the feed mechanism. A mechanism is provided for maintaining operable linkage between the feed cover mechanism and the remaining portions of the feed mechanism within the gun as the feed cover mechanism is configured between an opened and closed configuration.

As a result, access of the ammunition into the gun is facilitated without disruption of ammunition feed to the gun.

The ammunition fed to the gun is belted ammunition. The belted ammunition is engaged by the feed cover mechanism from one side and from the feed mechanism from an opposing side of the belted ammunition for feeding into the gun.

The feed cover mechanism is rotatably coupled to the gun along a predetermined axis of rotation. The mechanism for maintaining the linkage between the feed mechanism and feed cover mechanism comprises a linking pivot mechanism for mechanically coupling the feed cover mechanism and feed mechanism together. The linking pivot mechanism is disposed close to the predetermined axis of rotation of the feed cover mechanism.

In the illustrated embodiment the linking pivot mechanism is a ball and clasp combination.

The feed mechanism comprises a reciprocating cam follower, a fixed pivot, and a pivoted feed lever. The feed lever is rotatable about the fixed pivot relative to the gun. The reciprocating cam follower reciprocates with respect to the gun. The feed lever is coupled to the cam follower so that the feed lever is rotated about the fixed pivot when the cam follower is oscillated.

The feed cover mechanism comprises a cover pivot pin fixed relative to the gun. The cover pivot pin defines the predetermined axis of rotation. The feed cover mechanism comprises a cover housing including a fixed pivot and guide track, feed arm, reciprocating feed slide and at least one pawl. The feed arm is rotatable about the pivot fixed relative to the cover housing. The feed slide reciprocates within the feed housing within the guide track. The pawl is rotatably and resiliently coupled to the feed slide, and is generally arranged and configured for ratcheting engagement with the ammunition. The ball and clasp combination is aligned with the cover pivot pin.

The invention is also characterized as an improvement in a gun comprising an ammunition feed mechanism for automatically providing ammunition to the gun for firing. The feed mechanism is comprised of at least a first and second portion. The portions are selectively separable with respect to each other to allow access to the ammunition to the gun for firing by rotating the first and second portion with respect to each other. A mechanism is provided for linking the first and second portion at all times, including when the first and second are rotated relative with respect to each other to allow access to the ammunition.

As a result, ammunition within the gun may be changed and accessed without interference with continued operation of the feed mechanism when firing is resumed.

The first and second portion are rotatable relative to each other about a predetermined axis of rotation. The mechanism for linking the first and second portions is disposed along the predetermined axis and has a non-preferred angular orientation relative to the predetermined axis with respect to its operation. In the illustrated embodiment the mechanism for linking is a ball and clasp combination.

The mechanism for linking comprises a first element connected to the first portion of the feed mechanism. The first element is rotatable about a fixed pivot axis to define an arc of travel. The mechanism for linking further comprises a second element rotatable about the predetermined axis and reciprocates along a predetermined line parallel to a chord of the arc defined by movement of the first element about the fixed pivot. The first and second element are coupled in sliding engagement with each other.

In the illustrated embodiment the first element is a ball and the second element is two opposing arms defining a prismatic C-shaped slot. The ball disposed in the C-shaped slot defined by the two opposing arms.

The invention is also a method for allowing access to ammunition fed to an automated gun without allowing misalignment or requiring realignment of components of an ammunition feed mechanism included within the gun. The method comprising the steps of rotating a feed cover about a predetermined axis. The predetermined axis is fixed relative to the gun. The feed cover includes portions of the feed mechanism. Rotation of the feed cover opens the feed mechanism to allow access to ammunition within the feed mechanism. Mechanical linkage is maintained between portions of the feed mechanism within the feed cover and remaining portions of the gun during the step of rotating the feed cover. The step of maintaining linkage comprises the step of rotating a joint element about the predetermined axis while the joint element is in an arbitrary position as determined by rotation of the joint element about a second axis of rotation. The second axis of rotation is offset from and perpendicular to the predetermined axis of rotation.

As a result, the feed mechanism is opened and the ammunition is accessed without unlinking various components of the feed mechanism within the gun.

The step of rotating the feed cover about a predetermined axis is performed by rotating the feed cover about a pivot pin and simultaneously rotating an open C-shaped bracket having two opposing parallel arms rotated on and about the predetermined axis defined by the pivot pin.

The step of maintaining mechanical linkage between components of the feed mechanism comprises the step of disposing a ball within the C-shaped bracket. The ball is rotatable about the second axis of rotation to effect ammunition feed motion within the feed mechanism.

The invention may be better visualized by now turning to the following drawings wherein like elements are referenced by like numerals.

The invention and its various embodiments may now be better understood by turning to the following detailed description.

DETAILED DESCRIPTION OF THE PREFERRED EMBODIMENTS

A linkage is provided between various components within the feed mechanism of an automated gun which allows a feed cover, which includes some of the components of the feed mechanism, to be opened relative to other elements within the feed mechanism in order to allow access or changing of ammunition within the feed mechanism without unlinking the various feed mechanism components. Feed mechanism components within the gun are linked to other feed mechanism components within the rotatable feed cover by means of a ball and bracket combination. The feed cover rotates about a pivot pin on a predetermined axis. The bracket, through which the motive power supplied to the components of the feed mechanism and the feed cover, is disposed to lie on and is rotatable about the predetermined axis defined by the pivot pin. The ball, which is disposed on a rotatable lever coupled to feed mechanism components within the remaining portion of the gun, extends into the bracket so that the bracket may rotate about the ball when the feed cover is rotated on the predetermined axis defined by the pivot pin, and yet the bracket and ball remain operatively connected while the lever upon which the ball is disposed rotates about the differently oriented axis of rotation. The ball and bracket coupling is thus never disengaged even when the feed cover and the bracket with it is rotated relative to the ball.

Figure 1:
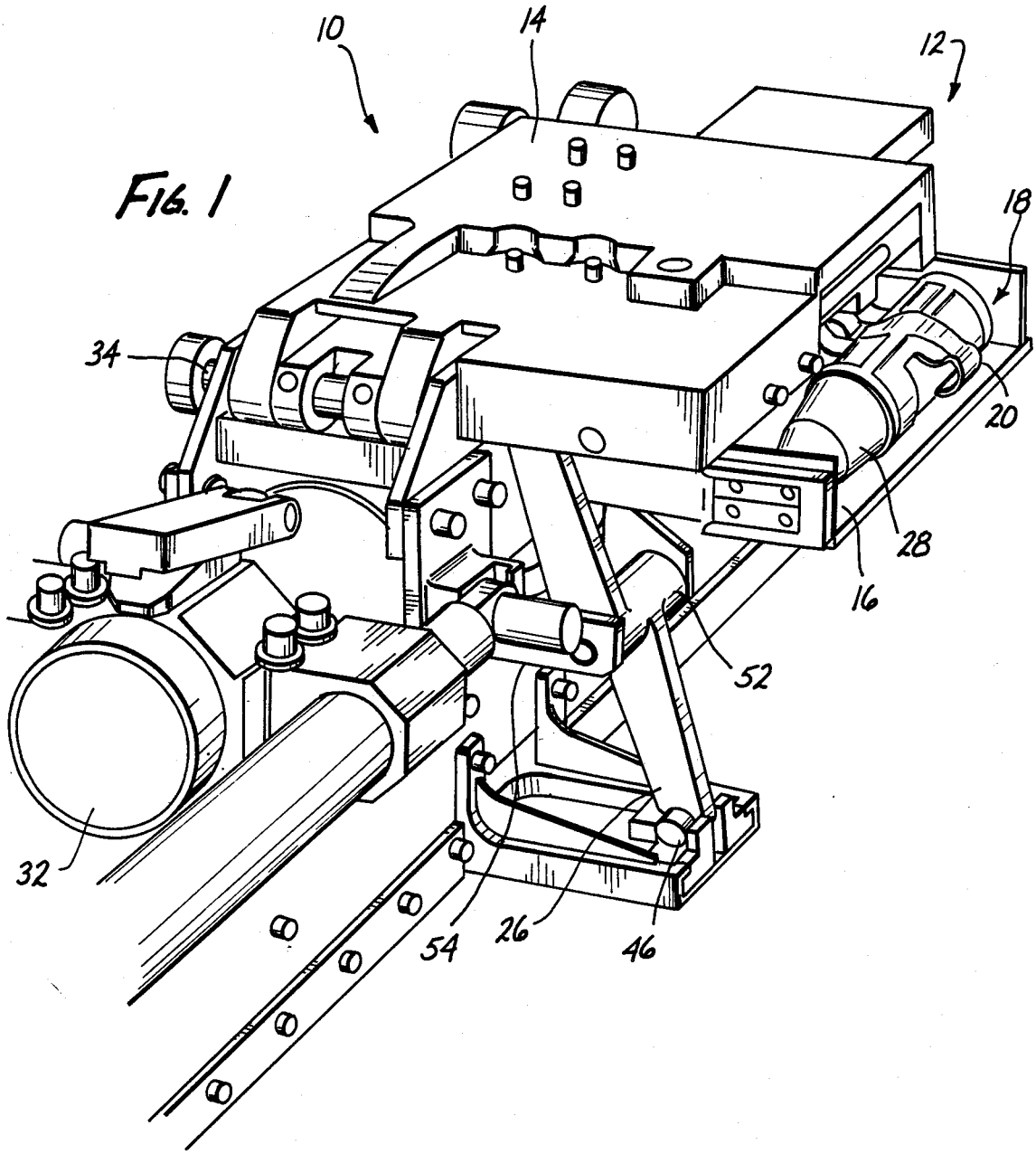
FIG. 1 is a perspective view of a portion of a gun incorporating a feed mechanism according to the invention with the feed mechanism shown in the closed configuration and as seen from a forward angle.

FIG. 1 is a perspective view of a portion of an automated cannon, generally denoted by reference numeral 10, as seen from a forward and slightly offcenter view. Only the material portions of cannon 10 have been illustrated and will be described for the sake of conciseness and clarity. Cannon 10 comprises a feed mechanism, generally denoted by reference numeral 12, which in turn is comprised of an openable top feed cover 14 and a fixed lower feed tray 16.

Figure 2:
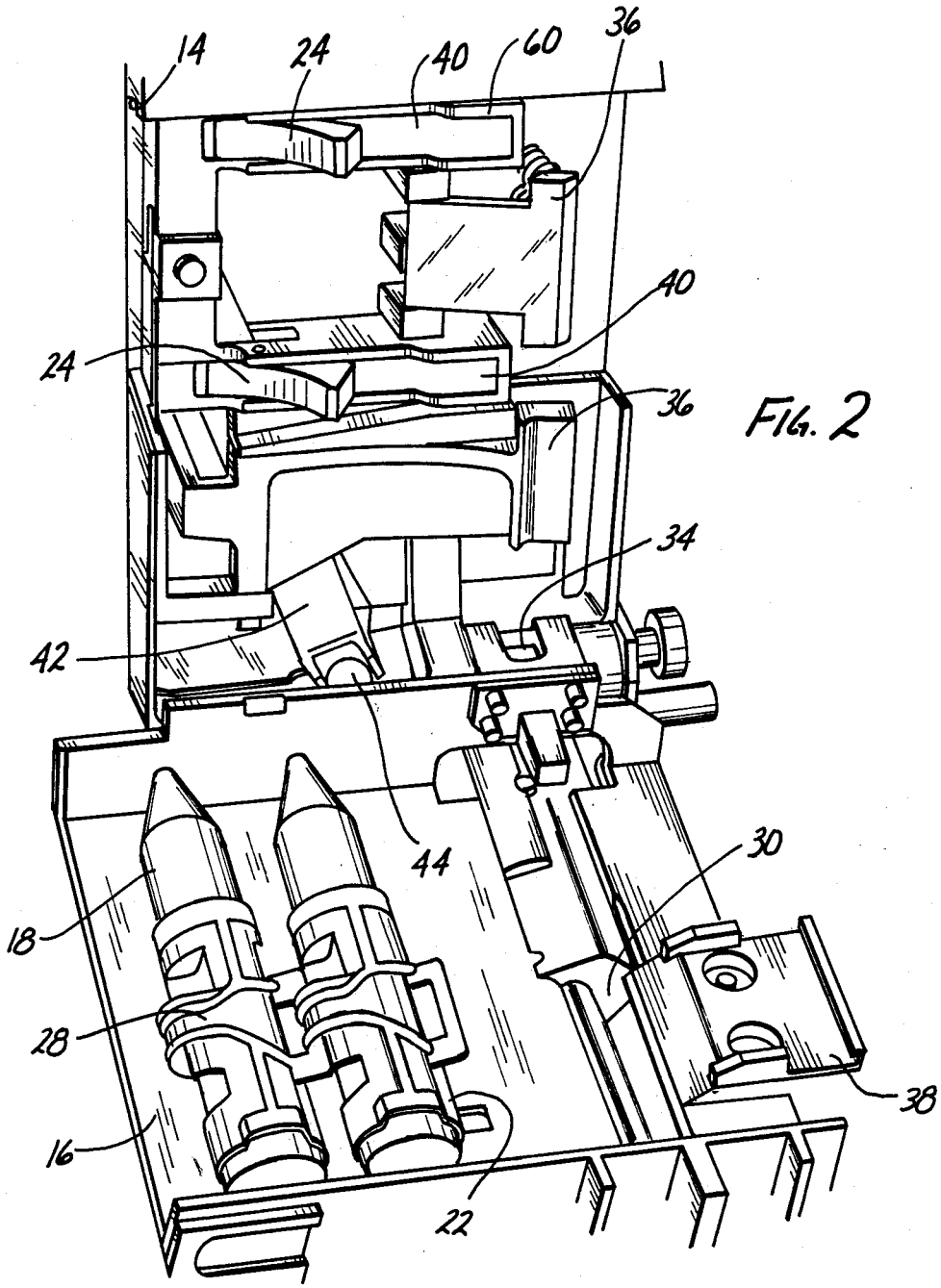
FIG. 2 is a plan elevational view of the mechanism of FIG. 1 shown from the rear of the mechanism looking forward with the feed mechanism open and with two rounds shown lying in the feed tray.

Ammunition, one linked and belted round 18 of which is visible in the depiction of FIG. 1, is fed from the right in FIG. 1 on feed tray 16 by means of a plurality of reciprocating pawls which are provided in feed cover 14 and a plurality of spring loaded pawls arranged and configured in feed tray 16 as best seen in FIG. 2 to engage the round from its lower surface adjacent to the supporting surface 20 of feed tray 16. One of which pawls 22 is partially visible in the perspective view of FIG. 2.

Pawls 24, described and shown in greater detail in connection with FIG. 2, are ultimately driven by reciprocating the feed lever 26 clearly shown in the perspective view of FIG. 1. As will be better understood below in connection with FIG. 2, rounds 18 are separated from ammunition links 28 and forced downwardly into breech 30 of cannon 10. Once loaded into breech 30, round 18 is then subject to a firing sequence which is not relevant to the invention and therefore will not be described. Ultimately, the round will be chambered and fired through barrel 32.

Feed cover 14 pivots forwardly about pivot pin 34 shown in FIG. 1. Feed cover 14 is in the closed configuration in FIG. 1 so that the mechanism within feed cover 14, such as pawls 24, engage linked rounds 18 for a normal feed sequence.

When the ammunition belt must be changed or accesed for any reason, feed cover 14 is rotated about pivot pin 34 forwardly into the open configuration depicted in the perspective view of FIG. 2. FIG. 2 illustrates pertinent portions of cannon 10 as seen from a rearward position with feed cover 14 opened.

In the illustration of FIG. 2, just two linked rounds 18 are shown as disposed in the feed tray for purposes of clarity. However, the linked ammunition would extend from the left in FIG. 2, across feed tray 16 and over breech 30 of gun 10, which breech is disposed beneath feed tray 16. The mechanisms described below, including pawls 24 and feed cover 14, move linked rounds 18 to the right in FIG. 2 to a position above breech 30, where spring loaded depressing and stripping levers 36 force round 18 into breech 30 stripping the round from the link while delinking block 38 holds belt link 28 above breech 30 and helps to strip links 28 from rounds 18. The emptied links 28 are thus ejected from the right of feed tray 16 while the spent cartridges are appropriately ejected from an ejection slot from breech 30 (not shown) and which is irrelevant to the teaching of the invention.

Pawls 24 are carried in slots 40 in a feed slide 60 which reciprocates within feed cover 14 to seize and force belted rounds 18 across feed tray 16 towards breech 30. Feed slide 60 is driven by a lever 42, only the lower end of which is visible in FIG. 2. Lever 42 in turn is driven through a ball joint 44 formed on the upper end of feed lever 26. The lower end of feed lever 26 as depicted in FIG. 1, in turn is pivoted to a reciprocating cam follower 46. Cam follower 46 in turn is driven by a conventional motive source within cannon 10, which may include either a conventional external motor and power train, or an internally powered mechanism. In either case, the mechanism for reciprocating cam follower 46 will not be further described or shown, and is not relevant to the invention.

The operative elements of the invention as shown and discussed in connection with FIGS. 1 and 2 can be better visualized and understood in the diagrammatic depictions of FIGS. 3–5 wherein selected ones of these elements are shown in isolation of the remaining portions of cannon 10, but are more clearly shown in relation to their operative connection with one another.

Figure 3:
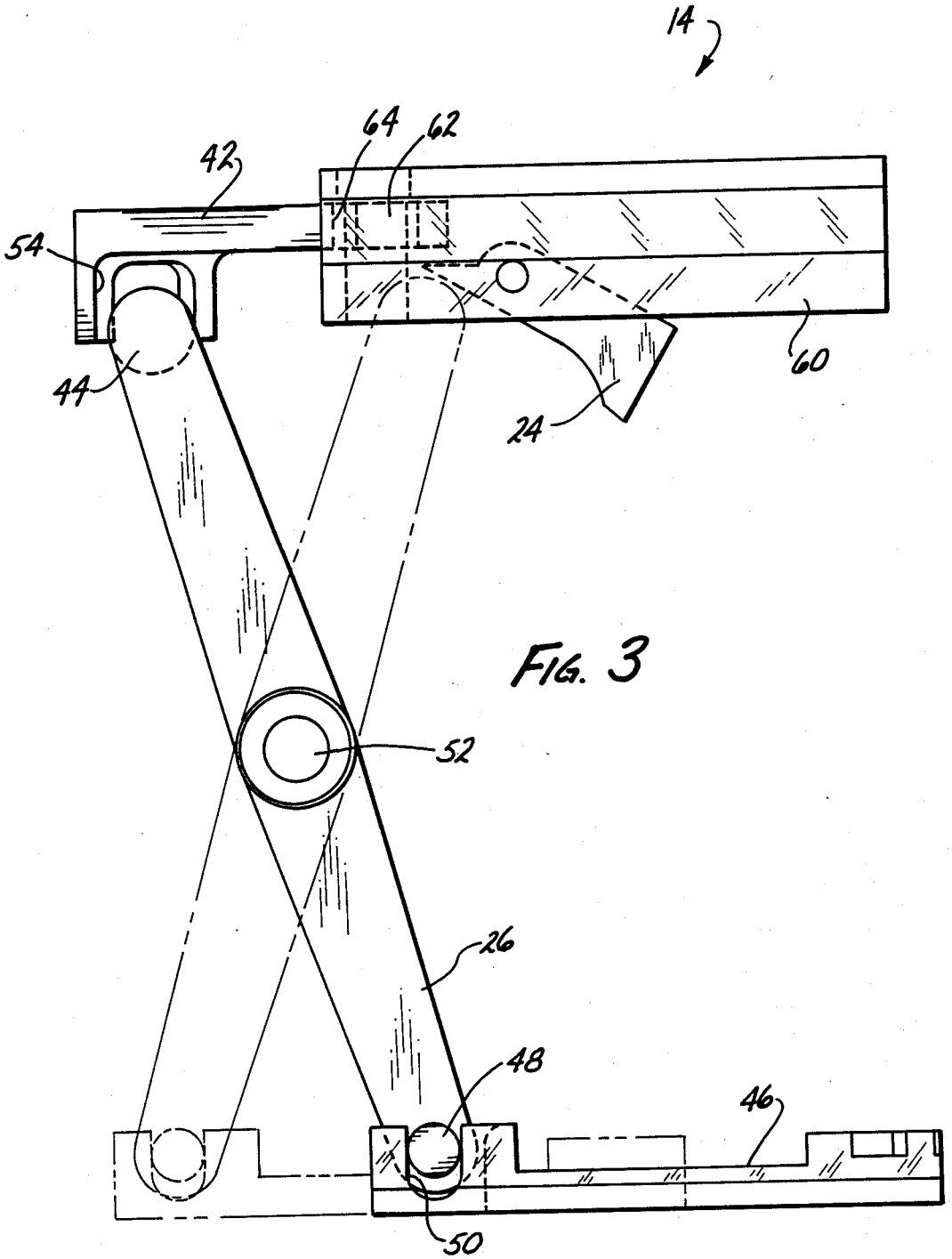
FIG. 3 is a side diagrammatic view of the primary operative elements of the mechanism depicted in FIGS. 1 and 2 with other portions of the mechanism deleted for the sake of simplicity.

Turn first to FIG. 3 which is a side diagrammatic view of the principal portions of the feed mechanism of cannon 10. FIG. 3 more clearly illustrates the reciprocating action of cam follower 46 shown in a rightmost position in solid outline and in dotted outline in a leftmost position in FIG. 3. Feed lever 26 is coupled to cam follower 46 by means of horizontally laid pin 48 disposed in slot 50. Pin 48 reciprocates vertically within slot 50 as cam follower 46 reciprocates horizontally. Feed lever 26 is pivoted about a fixed pivot pin 52 which is also illustrated in the perspective view of FIG. 1. Feed lever 26 in the illustrated embodiment is an offset arm as best depicted in FIG. 4, which is a diagrammatic side view of the operative elements shown in FIG. 3. Fixed pivot pin 52 is attached to the body of the gun by means of arms 54. The opposing end of feed lever 26 is provided with a ball 44 which is shown in its leftmost position in solid outline in FIG. 3 and in its rightmost rotated position in dotted outline. Ball 44 is disposed within a ball clasp 54 defined within feed arm 42 included as part of feed cover 14.

Figure 4:
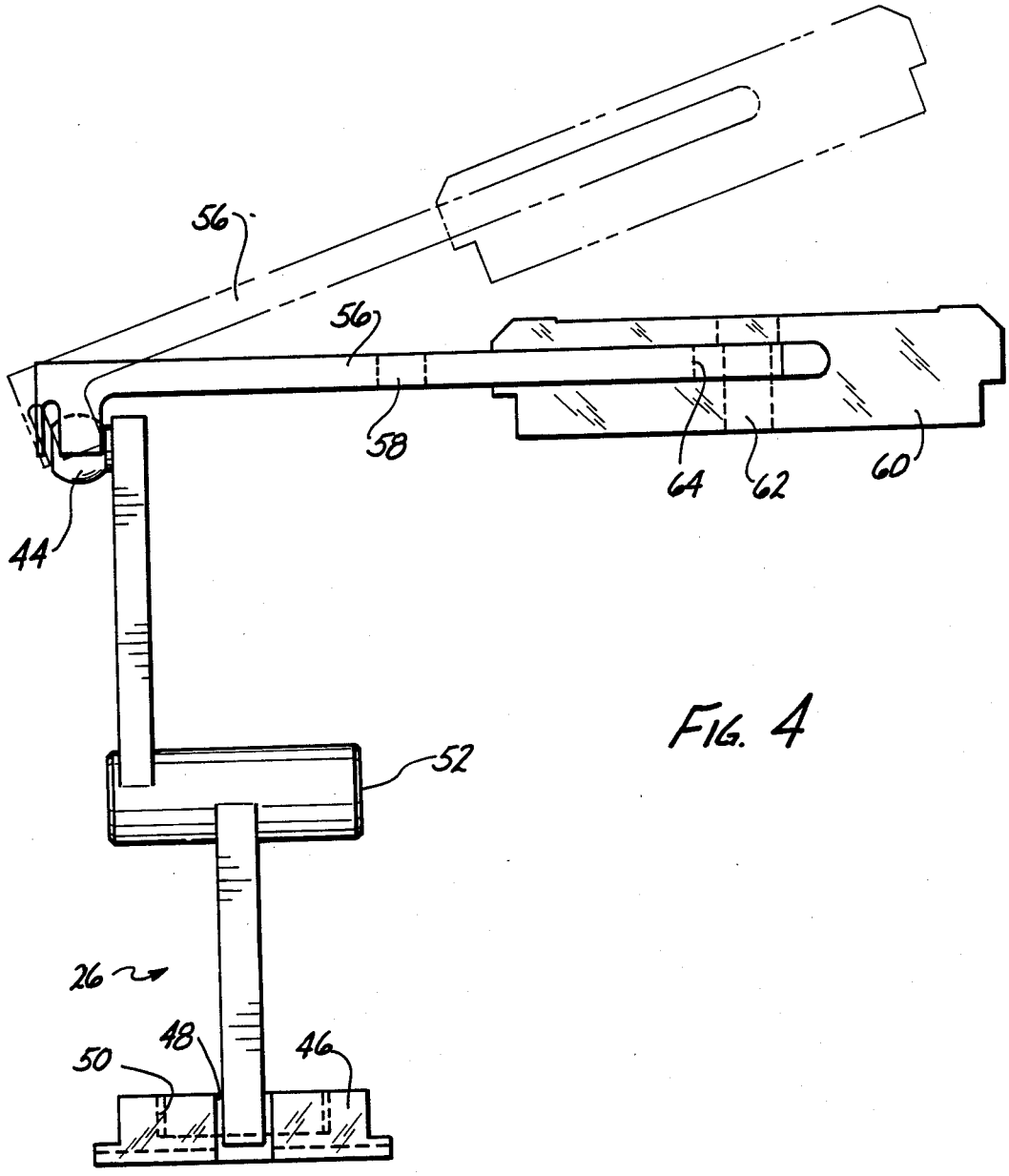
FIG. 4 is a diagrammatic end view of the elements shownn in FIG. 3 with the feed cover shown closed in solid outline and shown opened in dotted outline.
Figure 5:
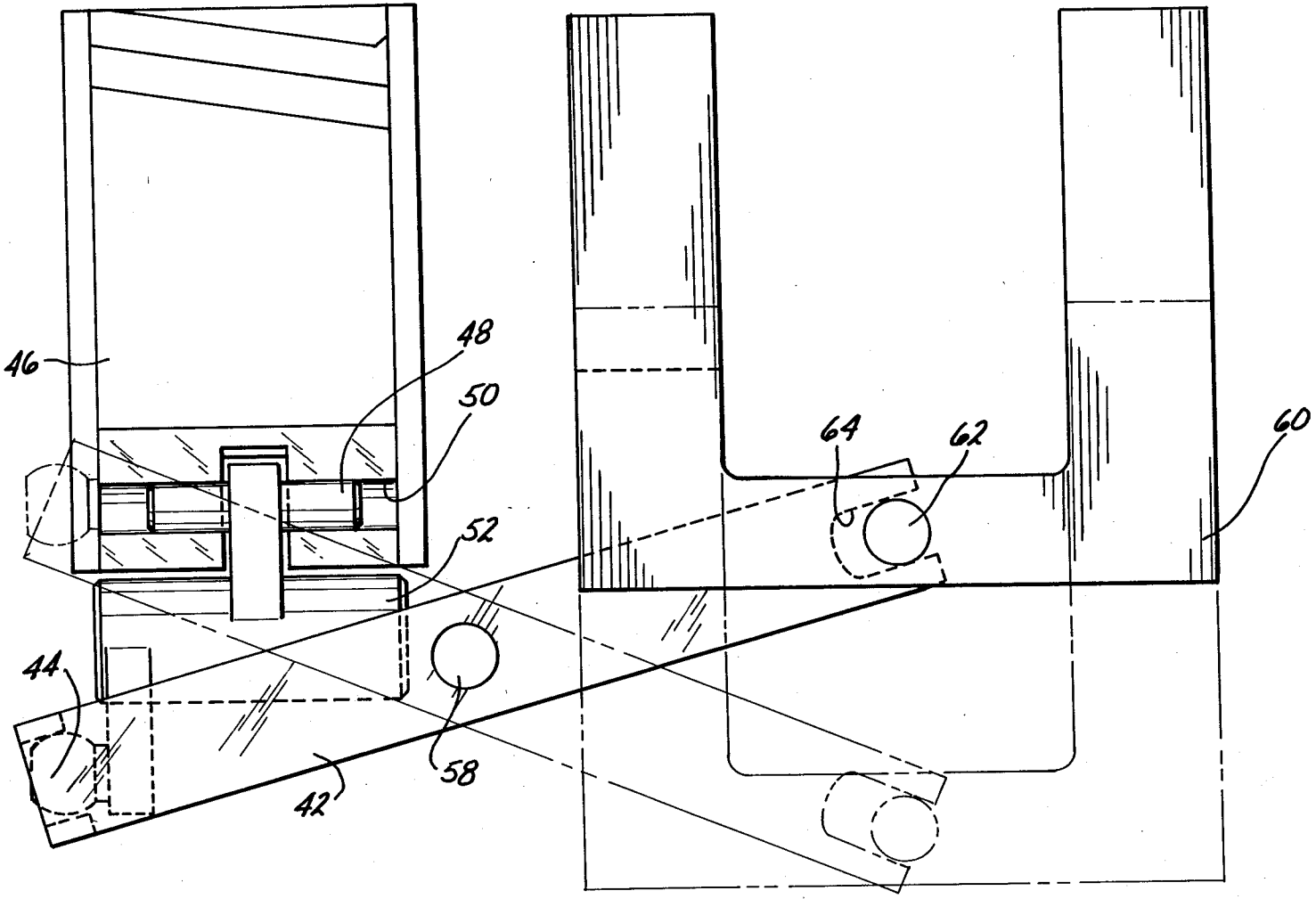
FIG. 5 is a diagrammatic plan view of the principal portions of the feed mechanism shown in FIGS. 3 and 4.

Feed arm 42 can best be visualized by considering the top plan view of FIG. 5 which is a diagrammatic depiction of the operative elements shown in FIGS. 3 and 4. Feed arm 42 rotates about a fixed pivot pin 58 which is fixed relative to feed cover 14 into which feed arm 42 is rotatingly disposed as depicted in FIG. 1. The opposing end of feed arm 42 is coupled to feed slide 60. Pin 62 extends from feed slide 60 and is fixed to slide 60. Pin 62 extends into a longitudinal slot 64 defined in the end of feed arm 42 so that, as feed arm 42 rotates about fixed pivot pin 58 and as feed slide 60 is retained within a longitudinal pathway within feed cover 14 (not shown), feed slide 60 moves from the position shown in solid outline in FIG. 4 at one extreme to the position shown in dotted outline in the other extreme.

Therefore, as feed slide 60 reciprocates in response to the rotation of feed arm 42, which in turn is rotated in response to the rotation of feed lever 26 and reciprocation of cam follower 46, spring loaded pawl 24 will be reciprocated horizontally across and above feed tray 16 to advance linked rounds 18 from left to right as shown in FIG. 3 and then to reindex themselves to a starting position, clicking over the next round to be fed as it moves from right to left in the view of FIG. 3.

The general operation of the primary elements of the feed mechanism now having been described, consider the operation of the feed mechanism when feed cover 14 is opened as depicted in the perspective view of FIG. 2. Pivot pin 34, about which feed cover 14 rotates, is approximately aligned with the center of ball 44 provided at the end of feed lever 26. Therefore, as feed cover 14 is rotated upwardly from the configuration of FIG. 1 to the open configuration of FIG. 2, clasp 54 of feed arm 42 which encases ball 44 remains in an engaging configuration with respect to ball 44 and simply rotates approximately 90 degrees about ball 44. Nevertheless, feed arm 42 remains positively engaged to ball 44 whether in the closed position depicted in solid outline in FIGS. 3 and 4 and shown in FIG. 1 in perspective, or whether in the open position shown in dotted outline in FIG. 4 and in perspective view in FIG. 2. In other words, if the gun were to operate in the open configuration of FIG. 2, the portion of the feed mechanism, included within feed cover 14, would operate in substantially the same manner as when in the enclosed configuration with of course the exception that pawls 24 of feed cover 14 would not in the open configuration be in a position to engage linked rounds 18.

Therefore, according to the teachings of the invention, it is readily apparent that feed cover 14 can be opened as shown in FIG. 2, the belted ammunition removed and any adjustment, whether intentional or inadvertent, can be made to the gun mechanism, causing the relative elements within the feed mechanism to change position while in the open configuration without disturbing in any sense the relative synchronization of portions of the feed mechanism and cover 14, such as the position of pawls 24 relative to other portions of the feed mechanism within the gun mechanism, such as pawls 22 or any breach mechanisms.

Cover 14 may then be returned to the closed configuration of FIG. 1 after new or different belted ammunition is placed within feed tray 16 without the need to realign, readjust or to give any consideration to the ammunition feed mechanism, what may have happened to it or its adjustment when the old belted ammunition was removed and new belt inserted.

Many modifications and alterations may be made by those having ordinary skill in the art without departing from the spirit and scope of the invention. Therefore, it must be understood that the illustrated embodiment has been set forth only for the purposes of example and should not be taken as limiting the invention which is defined in the following claims.

We claim:

1. An improvement in a feed mechanism for feeding ammunition to an automated gun comprising:

feed means for automatically feeding ammunition to said gun for firing;

an openable feed cover including driven means for automatically providing ammunition to said gun in cooperation with said feed means, said feed cover being openable to allow access to ammunition being supplied to said gun for firing, said feed cover being disposed in a portion of said gun separable at least in part from said feed means; and means for maintaining operable drive linkage between said driven means and said feed means within said gun as said feed cover is configured between an opened and closed configuration, whereby access of said ammunition into said gun is facilitated without disruption of ammunition feed to said gun.

2. The improvement of claim 1 wherein said ammunition fed to said gun is belted ammunition, said belted ammunition being engaged by said driven means from one side and from said feed means from an opposing side of said belted ammunition for feeding into said gun.

3. The improvement of claim 1 wherein said feed cover is rotatably coupled to said gun along a predetermined axis of rotation and wherein said means for maintaining said drive linkage between said feed means and driven means comprises linking pivot means for mechanically coupling said driven means and feed means together, said linking pivot means being disposed on said predetermined axis of rotation of said feed cover.

4. An improvement in a feed mechanism for feeding ammunition to an automated gun comprising:

feed means for automatically feeding ammunition to said gun for firing;

an openable feed cover including driven means for automatically providing ammunition to said gun in cooperation with said feed means, said feed cover being openable to allow access to ammunition being supplied to said gun for firing, said feed cover being disposed in a portion of said gun separable at least in part from said feed means; and means for maintaining operable drive linkage between said driven means and said feed means within said gun as said feed cover is configured between an opened and closed configuration, wherein said feed cover is rotatably coupled to said gun along a predetermined axis of rotation and wherein said means for maintaining said drive linkage between said feed means and driven means comprises linking pivot means for mechanically coupling said driven means and feed means together, said linking pivot means being disposed on said predetermined axis of rotation of said feed cover, wherein said linking pivot means is a ball and clasp combination, whereby access of said ammunition into said gun is facilitated without disruption of ammunition feed to said gun.

5. The improvement of claim 4 wherein said feed means comprises a reciprocating cam follower, a fixed pivot, and a pivoted feed lever, said feed lever being rotatable about said fixed pivot relative to said gun, said reciprocating cam follower reciprocating with respect to said gun, said feed lever coupled to said cam follower so that said feed lever is rotated about said fixed pivot when said cam follower is rotated.

6. The improvement of claim 5 wherein said feed cover means comprises a cover pivot pin fixed relative to said gun, said cover pivot pin defining said predetermined axis of rotation, said feed cover means comprising a cover housing including a fixed pivot and guide track, feed arm, reciprocating feed slide and at least one pawl, said feed arm rotatable about said pivot fixed relative to said cover housing, said feed slide reciprocating within said feed housing within said guide track, said pawl rotatably and resiliently coupled to said feed slide and arranged and configured for ratcheting engagement with said ammunition, said ball and clasp combination being aligned with said cover pivot pin.

7. The improvement of claim 4 wherein said feed cover means comprises a cover pivot pin fixed relative to said gun, said cover pivot pin defining said predetermined axis of rotation, said feed cover means comprising a cover housing including a fixed pivot and guide track, feed arm, reciprocating feed slide and at least one pawl, said feed arm rotatable about said pivot fixed relative to said cover housing, said feed slide reciprocating within said feed housing within said guide track, said pawl rotatably and resiliently coupled to said feed slide and arranged and configured for ratcheting engagement with said ammunition, said ball and clasp combination being aligned with said cover pivot pin.

8. An improvement in a gun with a motive power source comprising:

an ammunition feed means for automatically providing ammunition to said gun for firing driven by said motive power source, said feed means being comprised of at least a first and second portion, said portions selectively separable with respect to each other to allow access to said ammunition to said gun for firing by rotating said first and second portion with respect to each other said first and second portion each being driven to feed ammunition into said gun for firing; and means for maintaining drive linkage between said first and second driven portions at all times, including when said first and second driven portions are rotated relative with respect to each other to allow access to said ammunition, whereby ammunition within said gun may be changed and accessed without interference with continued operation of said feed mechanism when firing is resumed.

9. The improvement of claim 8 wherein said first and second portions are rotatable relative to each other about a predetermined axis of rotation, said means for maintaining drive linkage between said first and second portions being disposed along said predetermined axis and being artibrarily angularly oriented relative to said predetermined axis during operation of said means for maintaining drive linkage.

10. An improvement in a gun comprising:

an ammunition feed means for automatically providing ammunition to said gun for firing, said feed means being comprised of at least a first and second driven portion, said portions selectively separable with respect to each other to allow access to said ammunition to said gun for firing by rotating said first and second portion with respect to each other; and means for linking said first and second driven portions at all times, including when said first and second driven portions are rotated relative with respect to each other to allow access to said ammunition, wherein said means for linking is a ball and clasp combination, whereby ammunition within said gun may be changed and accessed without interference with continued operation of said feed mechanism when firing is resumed.

11. The improvement of claim 10 wherein said first portion comprises a reciprocating cam follower, a fixed pivot, and a pivoted feed lever, said feed lever being rotatable about said fixed pivot relative to said gun, said reciprocating cam follower reciprocating with respect to said gun, said feed lever coupled to said cam follower so that said feed lever is rotated about said fixed pivot when said cam follower is rotated.

12. The improvement of claim 11 wherein said second portion comprises a cover pivot pin fixed relative to said gun, said cover pivot pin defining said predetermined axis of rotation, said second portion comprising a cover housing including a fixed pivot and guide track, feed arm, reciprocating feed slide and at least one pawl, said feed arm rotatable about said pivot fixed relative to said cover housing, said feed slide reciprocating within said feed housing within said guide track, said pawl rotatably and resiliently coupled to said feed slide and arranged and configured for ratcheting engagement with said ammunition, said ball and clasp combination being aligned with said cover pivot pin.

13. The improvement of claim 10 wherein said second portion comprises a cover pivot pin fixed relative to said gun, said cover pivot pin defining said predetermined axis of rotation, said second portion comprising a cover housing including a fixed pivot and guide track, feed arm, reciprocating feed slide and at least one pawl, said feed arm rotatable about said pivot fixed relative to said cover housing, said feed slide reciprocating within said feed housing within said guide track, said pawl rotatably and resiliently coupled to said feed slide and arranged and configured for ratcheting engagement with said ammunition, said ball and clasp combination being aligned with said cover pivot pin.

14. An improvement in a gun with at motive power source comprising:

ammunition feed means for automatically providing ammunition to said gun for firing driven by said motive power source, said feed means being comprised of at least a first and second portion, said portions selectively separable with respect to each other to allow access to said ammunition to said gun for firing by rotating said first and second portion with respect to each other said first and second portions each being driven to feed ammunition into said gun for firing; and means for maintaining drive linkage between said first and second driven portions at all times, including when said first and second driven portions are rotated relative with respect to each other to allow access to said ammunition, wherein said first and second portion are rotatable relative to each other about a predetermined axis of rotation, said means for maintaining drive linkage between said first and second portions being disposed along said predetermined axis and being arbitrarily angularly oriented relative to said predetermined axis during operation of said means for maintaining drive linkage, wherein said means for linking is a ball and clasp combination, whereby ammunition within said gun may be changed and accessed without interference with continued operation of said feed mechanism when firing is resumed.

15. An improvement in a gun with a motive power source comprising:

ammunition feed means for automatically providing ammunition to said gun for firing driven by said motive power source, said feed means being comprised of at least a first and second portion, said portions selectively separable with respect to each other to allow access to said ammunition to said gun for firing by rotating said first and second portion with respect to each other said first and second portions, each being driven to feed ammunition into said gun for firing; and means for maintaining drive linkage between said first and second driven portions at all times, including when said first and second are rotated relative with respect to each other to allow access to said ammunition, wherein said means for linking comprises a first element connected to said first portion of said feed mechanism, said first element rotatable about a fixed pivot axis to define an arc of travel, said means for linking further comprising a second element rotatable about said predetermined axis and reciprocating along a predetermined line parallel to a chord of said arc defined by movement of said first element about said fixed pivot, said first and second element coupled in sliding engagement with each other, whereby ammunition within said gun may be changed and accessed without interference with continued operation of said feed mechanism when firing is resumed.

16. The improvement of claim 15 wherein said first element is a ball and wherein said second element is two opposing arms defining a prismatic C-shaped slot, said ball disposed in said C-shaped slot defined by said two opposing arms.

17. A method for allowing access to ammunition fed to an automated gun while maintaining alignment of components of an ammunition feed mechanism included within said gun, said method comprising the steps of:

rotating a feed cover about a predetermined axis, said predetermined axis being fixed relative to said gun, said feed cover including driven portions of said feed mechanism, rotation of said feed cover opening said feed mechanism allowing access to ammunition within said feed mechanism; and maintaining mechanical drive linkage between driven portions of said feed mechanism within said feed cover and remaining portions of said gun during said step of rotating said feed cover, wherein said step of maintaining drive linkage comprises the step of rotating a joint element about said predetermined axis while said joint element is in an arbitrary position as determined by rotation of said joint element about a second axis of rotation, said second axis of rotation offset from and perpendicular to said predetermined axis of rotation, whereby said feed mechanism is opened and said ammunition is accessed while various components of said feed mechanism within said gun remain linked.

18. A method for allowing access to ammunition fed to an automated gun while maintaining alignment of components of an ammunition feed mechanism included within said gun, said method comprising the steps of:

rotating a feed cover about a predetermined axis, said predetermined axis being fixed relative to said gun, said feed cover including driven portions of said feed mechanism, rotation of said feed cover opening said feed mechanism allowing access to ammunition within said feed mechanism; and maintaining mechanical drive linkage between driven portions of said feed mechanism within said feed cover and remaining portions of said gun during said step of rotating said feed cover, wherein said step of maintaining drive linkage comprises the step of rotating a joint element about said predetermined axis while said joint element is in an arbitrary position as determined by rotation of said joint element about a second axis of rotation, said second axis of rotation offset from and perpendicular to said predetermined axis of rotation, where said step of rotating said feed cover about a predetermined axis is performed by rotating said feed cover about a pivot pin and simultaneously rotating an open C-shaped bracket having two opposing parallel arms rotated on and about said predetermined axis defined by said pivot pin, whereby said feed mechanism is opened and said ammunition is accessed while various components of said feed mechanism within said gun remain linked.

19. The method of claim 18 wherein said step of maintaining mechanical linkage between components of said feed mechanism comprises the step of disposing a ball within said C-shaped bracket, said ball being rotatable about said second axis of rotation to effect ammunition feed motion within said feed mechanism.

20. A method for allowing access to ammunition fed to an automated gun while maintaining alignment of components of an ammunition feed mechanism included within said gun, said method comprising the steps of:

rotating a feed cover about a predetermined axis, said predetermined axis being fixed relative to said gun, said feed cover including driven portions of said feed mechanism, rotation of said feed cover opening said feed mechanism allowing access to ammunition within said feed mechanism; and maintaining mechanical drive linkage between driven portions of said feed mechanism within said feed cover and remaining portions of said gun during said step of rotating said feed cover, wherein said step of maintaining drive linkage comprises the step of rotating a joint element about said predetermined axis while said joint element is in an arbitrary position as determined by rotation of said joint element about a second axis of rotation, said second axis of rotation offset from and perpendicular to said predetermined axis of rotation, wherein said step of maintaining mechanical linkage between components of said feed mechanism comprises the step of disposing a ball within said C-shaped bracket, said ball being rotatable about said second axis of rotation and rotatable through said arc having a chord parallel to said predetermined axis, whereby said feed mechanism is opened and said ammunition is accessed while various components of said feed mechanism within said gun remain linked.

21. A method for allowing access to ammunition fed to an automated gun while maintaining alignment of components of an ammunition feed mechanism included within said gun, said method comprising the steps of:

rotating a feed cover about a predetermined axis, said predetermined axis being fixed relative to said gun, said feed cover including driven portions of said feed mechanism, rotation of said feed cover opening said feed mechanism allowing access to ammunition within said feed mechanism; and maintaining mechanical drive linkage between driven portions of said feed mechanism within said feed cover and remaining portions of said gun during said step of rotating said feed cover.

* * * * *